United States Patent [19]

Bickerstaff et al.

[11] Patent Number: 4,905,049

[45] Date of Patent: Feb. 27, 1990

[54] TONER FUSING APPARATUS

[75] Inventors: Alan E. Bickerstaff, London; Barry J. Collier, Henlow; Joseph F. Hale, Welwyn; Peter M. Hitchmough, Wirral; Ian Pitts, Cambridge; Ghulam Rasul, Hemel Hempstead, all of England

[73] Assignee: Xerox Corporation, Stamford, Conn.

[21] Appl. No.: 184,212

[22] Filed: Apr. 21, 1988

[30] Foreign Application Priority Data

Jun. 22, 1987 [GB] United Kingdom ..... 8714588

[51] Int. Cl.[4] ..... G03G 15/20; G03G 21/00

[52] U.S. Cl. ..... 355/284; 355/290; 219/216; 219/388

[58] Field of Search ..... 355/3 FU, 14 FU, 3 SH, 355/282–285, 289, 290, 295; 219/216, 388, 469, 470, 471; 118/60; 432/60

[56] References Cited

U.S. PATENT DOCUMENTS

| | | | |
|---|---|---|---|
| 3,929,094 | 12/1975 | Thettu | 219/216 X |
| 4,045,165 | 8/1977 | Nakajima et al. | 432/60 |
| 4,145,599 | 3/1979 | Sakurai et al. | 219/216 |
| 4,197,445 | 4/1980 | Moser | 219/216 |
| 4,231,653 | 11/1980 | Nagahara et al. | 355/3 FU |

FOREIGN PATENT DOCUMENTS

| | | | |
|---|---|---|---|
| 56-55976 | 5/1981 | Japan . | |
| 0134674 | 8/1983 | Japan | 355/3 FU |
| 58-168072 | 10/1983 | Japan . | |
| 0113471 | 6/1984 | Japan | 355/3 FU |
| 59-185374 | 10/1984 | Japan . | |
| 1434089 | 4/1976 | United Kingdom . | |

*Primary Examiner*—A. T. Grimley
*Assistant Examiner*—Edward J. Pipala
*Attorney, Agent, or Firm*—H. Fleischer; J. E. Beek; R. Zibelli

[57] ABSTRACT

An apparatus for applying release oil to a fuser roller pair in a xerographic copier comprises an elongated trough containing a supply of oil in the base thereof, and wick for drawing up the oil from the trough and applying it to a metering roller. The metering roller applies the oil to a donor roller which, in turn, transfers the oil to the heated roller of the fuser roller pair. An upper guide device is provided on the exit side of the fuser by ribs formed integrally on the underside of the trough. The trough and guide ribs may thus have a compact configuration that is suited to inexpensive manufacture, e.g. by molding, as a one piece item. A lower guide member is fixed to the fuser assembly. Also, stripper fingers are mounted integrally on the trough adjacent the upper guides, the fingers being provided with slots through which the ribs extends.

7 Claims, 6 Drawing Sheets

TONER FUSING APPARATUS

This invention relates generally to an apparatus for fusing toner images on copy substrates, and more particularly to such an apparatus which affects fusing by the combined application of heat and pressure. This fusing apparatus is suitable for use in an electrostatographic recording machine such as, for example, a xerographic copier.

In a xerographic copier a light image of an original document to be reproduced is recorded in the form of a latent electrostatic image on a photosensitive member. The latent image is rendered visible by the application of a resin based powder known as toner. The visual toner image is transferred electrostatically from the photosensitive member on to sheets of paper or other substrates. The toner image is then fixed or "fused", for example by applying heat and pressure, which causes the toner material to become soft and tacky whereby it is able to flow into the fibers or pores of the substrate or otherwise upon the surface thereof. Thereafter, as the toner material cools, it solidifies and is bonded firmly to the substrate. In the electrostatographic art generally the use of thermal energy and pressure for fixing toner images on to a substrate is well known.

It has long been recognized that one of the fastest and most positive methods of applying both heat and pressure for fusing the toner image to the substrate is by direct contact of the resin based toner image with a hot surface such as a heat roller which also applies pressure to the substrate. One approach is to pass the substrate with the toner image thereon between a pair of opposed rollers forming a nip, at least one of the rollers being internally heated. The actual temperature and pressure ranges will of course vary depending upon the softening range of the particular resin used in the toner. Typically, however, it will be necessary to heat the toner powder above 180° C. Temperatures of 198° C. or even higher are not uncommon in commercial fusers. Corresponding nip pressures are in the range of 690 to 1380 $kN/m^2$.

A problem with this kind of fuser is that, as the toner becomes tacky, it can stick to the surface of the fuser roller which is undesirable because some of the toner on the fuser roller can then be transferred to subsequent substrates being fused and, moreover, those subsequent substrates will in their turn give rise to even more toner sticking to the fuser roller. This effect, known as "offset", clearly impairs copy quality. Furthermore, if the rollers are rotated when there is no substrate present in the nip therebetween, toner may also be transferred from the fuser roller to the backup roller so that when a substrate subsequently passes through the nip some of the toner may be transferred to the reverse side thereof.

An arrangement for minimizing the problem of offset has been to provide a fuser roller with an outer surface or covering of, for example, polytetrafluoroethene known by the trade name Teflon, to which a liquid release agent such as silicone oil is applied. The thickness of the Teflon is typically of the order of tens of microns and the thickness of the oil is less than 1 micron. Silicone based oils, for example polydimethylsiloxane, which possess a relatively low surface energy, have been found to be suitable for use in the heated fuser roller environment where Teflon constitutes the outer surface of the fuser roller. In practice, a thin layer of silicone oil is applied to the surface of the heated roller to form an interface between the roller surface and the toner images carried on the substrate. Thus, a low surface energy layer is presented to the toner as it passes through the fuser nip thereby preventing toner from offsetting to the fuser roller surface.

In attempts to improve the quality of the image fused by a heat roller fuser, such rollers have been provided with conformable surfaces comprising silicone rubber or Viton (Trademark of E I Du Pont for a series of fluoroelastomers based on the copolymer of vinyladinefluoride and hexafluoropropylene). As in the case of the Teflon coated fuser roller, release fluids such as silicone based oils are applied to the surface of the silicone rubber or Viton to both minimize offsetting and to facilitate stripping. When the fuser system is one which provides for applying silicone oil to silicone rubber or Viton, a low viscosity silicone oil (i.e. in the order of 100 to 1000 centistokes) has most commonly been employed, although liquids of relatively high viscosity, for example 12,000 to 60,000 centistokes and higher, have also been used.

Various forms of applicator have been employed to supply the liquid release agent to the surface of the fuser roller. The following disclosures appear to be relevant: U.S. Pat. No. 4,145,599; Patentee: Sakurai et al. Issued: Mar. 20, 1979. U.S. Pat. No. 4,231,653; Patentee: Nagahara et al. Issued: Nov. 4, 1980. JPPN 56-55976; Applicant: Sakurai. Published: May 16, 1981. JPPN 58-168072; Applicant: Washiyama. Published: Oct. 4, 1983. JPPN 59-185374; Applicant: Ootsuka. Published: Oct. 20, 1984.

The relevant portions of the foregoing disclosures may be briefly summarized as follows:

U.S. Pat. No. 4,145,599 describes a fixing device having a pair of rollers spaced from one another. The rollers press against one another during fixing with one of the rollers being heated. A stripper claw is positioned adjacent each of the rollers to strip the copying material from the rollers after fixing. A wick meters a release fluid from a reservoir onto a roller which coats the heated roller therewith. Both stripper claws are shown positioned on the exit side of the fixing device beneath the reservoir.

U.S. Pat. No. 4,231,653 discloses an applicator comprising an elongated trough containing a supply of release oil. A wick which is partially immersed in the release oil supply draws the oil up from the trough for application to the fuser via a pair of cooperating rollers in pressure contact, namely a driven oil application roller and a freely rotatable oil supply roller. The wick is in engagement with the oil supply roller and thus applies the release oil directly to the surface thereof. The oil supply roller slips on the application roller and is not rotated when there is some oil present between the two rollers, but as the oil runs out the oil supply roller is driven by the oil application roller since the coefficient of friction therebetween is increased. In other words, the oil supply roller is rotated only when there is little or no oil on the surface of the oil application roller due to the application of oil to the fuser and thus the cooperating roller pair acts as a metering device for checking the amount of release oil conveyed to the fuser. A pair of upper and lower guide members, which are fixed to the main assembly of the copier, are provided on the exit side of the fuser to guide copy sheets as they are discharged therefrom.

JPPN No. 56-55976 discloses a fixing device having a separating claw adjacent a fixing roller on the exit side of the device to separate an image carrying body from the fixing roller. The separating claw has an image carrying body guide surface and two grooves extending from the contact surface to a Nylon felt belt behind the claw. Another piece of felt contacted the belt. The image carrying body guide surface and grooves are formed of an oil repellant material. This prevents the image carrying body from being stained with offset preventing liquid.

JPPN No. 58-168072 describes a fixing roll having an offsetting liquid applied thereon by a felt wick. One end of the wick engages the roll with the other end thereof being in a reservoir storing a supply of offsetting liquid therein. Copy sheet strippers are mounted pivotably below the reservoir with the free ends thereof engaging the fixing roll and backup roll, respectively, at the exit side of the device.

JPPN No. 59-185374 discloses a fusing device in which copy sheet separators are located adjacent a reservoir storing a supply of offset preventing solution. The free end of the strippers contact the fixing roll and backup roll, respectively, to separate the copy sheet therefrom.

Conventionally the paper guide and stripping functions are separated from each other and the stripper devices are normally individually spring loaded assemblies often requiring intricate assembly within the copier.

According to the present invention there is provided an apparatus for fusing toner images on copy substrates. The apparatus includes means for applying heat and pressure to the toner images on the copy substrates. An elongated trough containing a supply of release fluid is provided. Means receive the release fluid from the elongated trough for application onto the applying means. Means guide the copy substrate exiting the applying means. The guiding means is formed integrally with the elongated trough.

Integrating the fuser exit copy sheet guides with the oil trough in accordance with the invention enables a particularly compact configuration which is relatively inexpensive to manufacture and is ideally suited to being molded as a one piece item. Moreover, the guide means suitably in the form of ribs on the underside of the trough, may also act as strengthening features for the trough.

In one embodiment means for stripping a copy sheet from the applying means is also mounted integrally on the trough. The stripping means is preferably in the form of resilient blade like fingers which are arranged so that the ends thereof remote from the trough engage the applying means. Each finger is provided with a slot to accommodate a guide rib. The ribs are adapted to provide abutments and hence support for the fingers on the side remote from the copy substrate. This arrangement has the benefit that it is assembled in a straightforward manner outside the copier and is then inserted into the copier as a one piece unit.

An embodiment of the invention will now be described, by way of example, with reference to the accompanying drawings in which.

Figure 3:
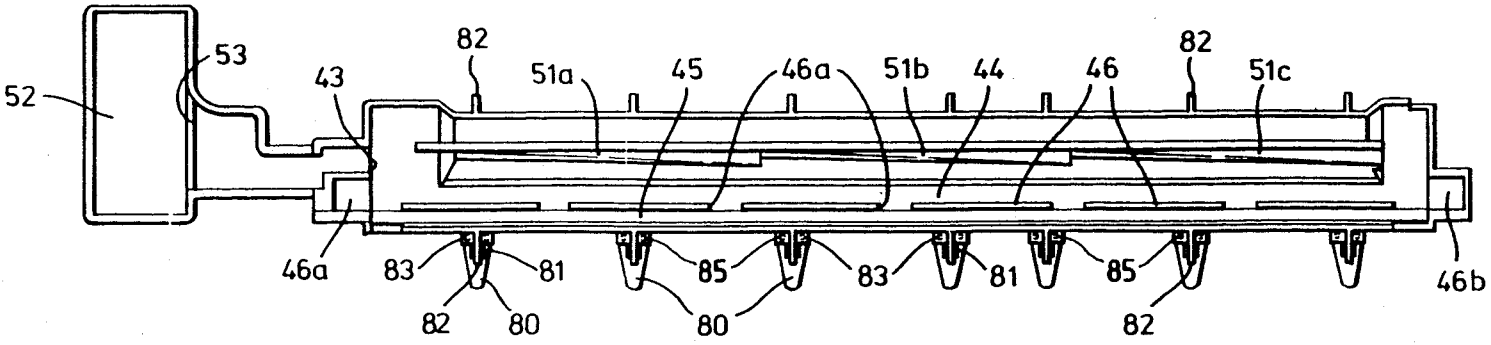
FIG. 3 is a plan view of the applicator trough used in the FIG. 2 fusing apparatus.
Figure 4:
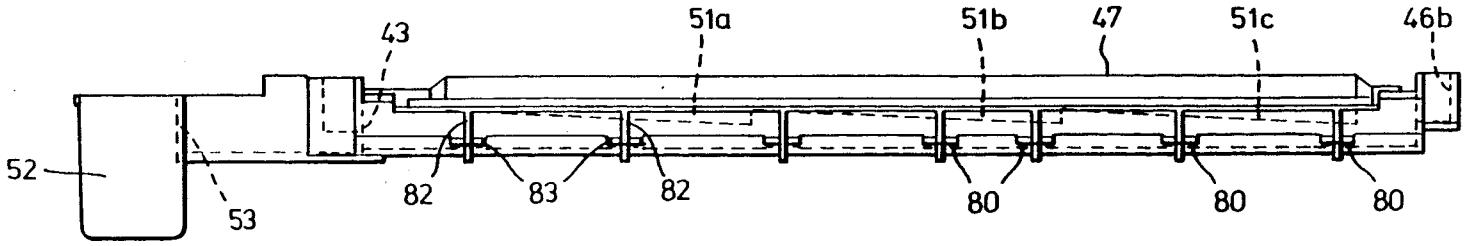
FIG. 4 is a front elevation view of the FIG. 3 applicator trough.
Figure 5:
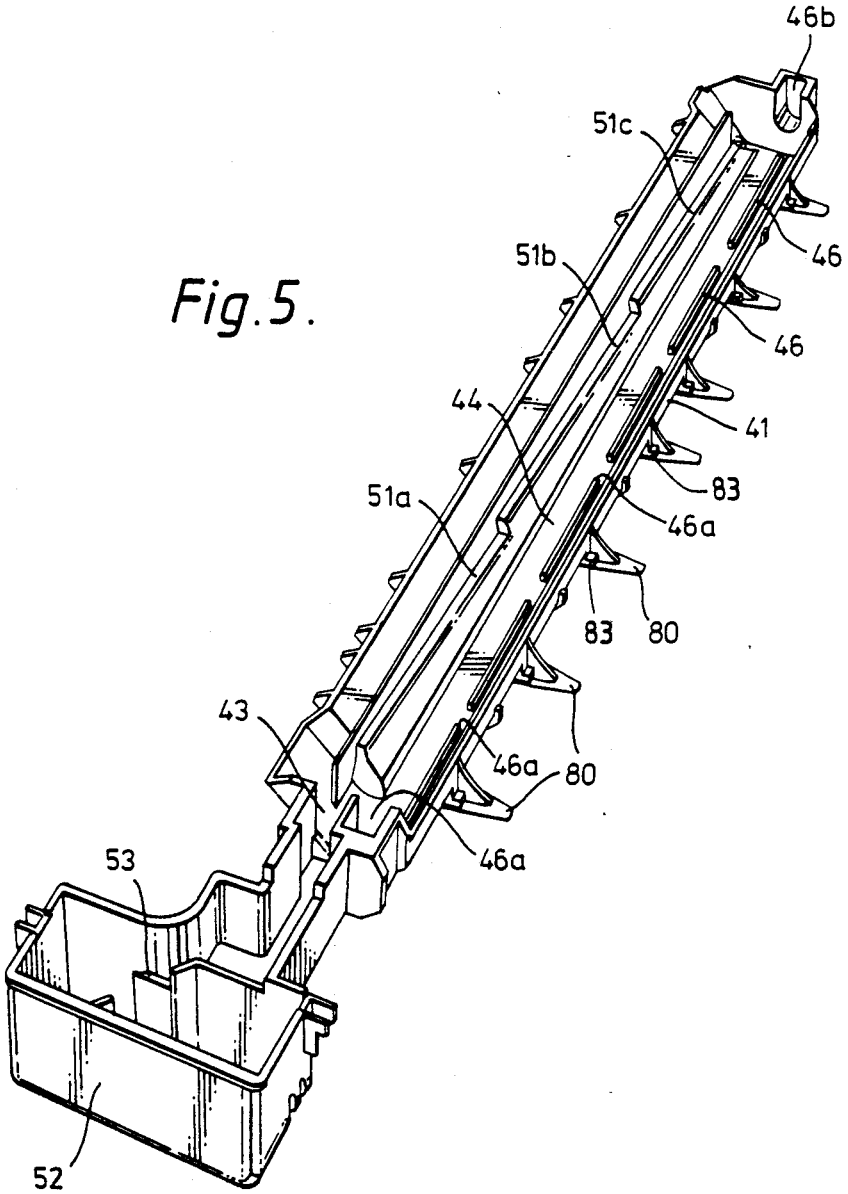
FIG. 5 is a perspective view showing the inside of the FIG. 3 applicator trough.
Figure 6:
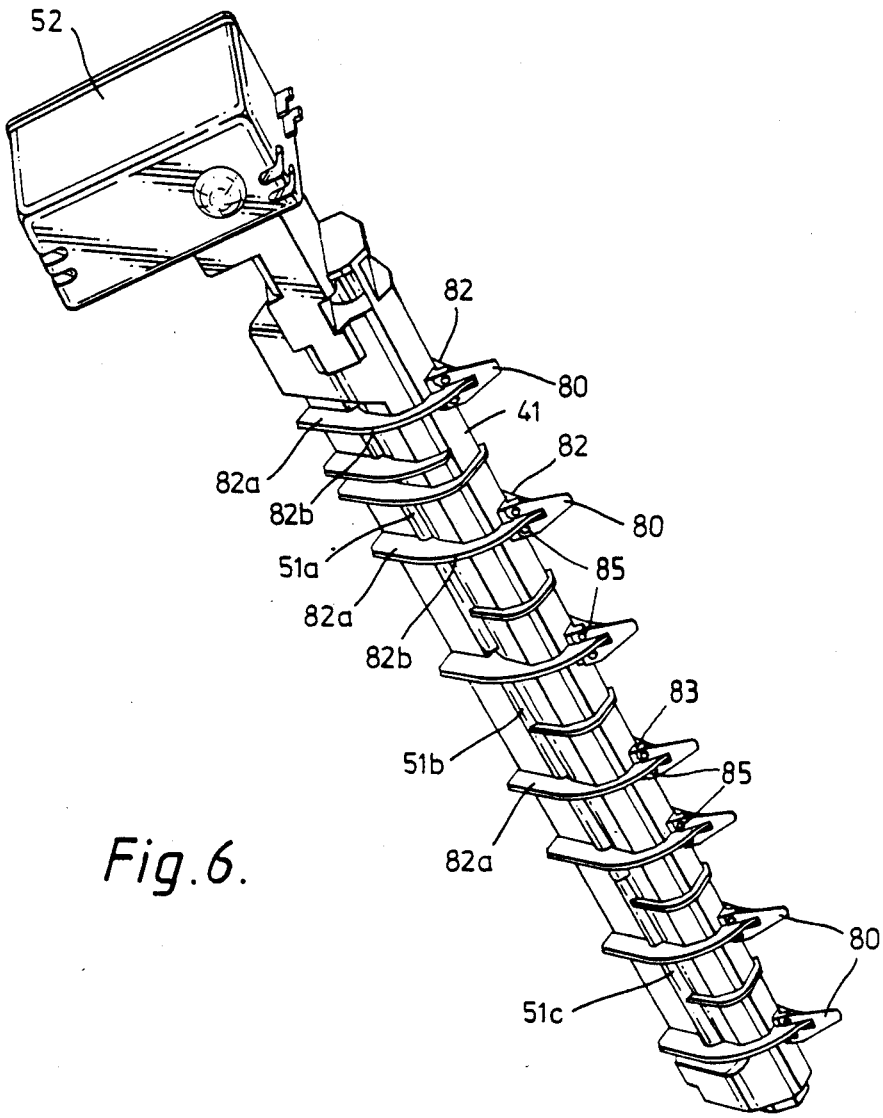
FIG. 6 is a perspective view showing the underside of the FIG. 3 applicator trough.
Figure 7A:
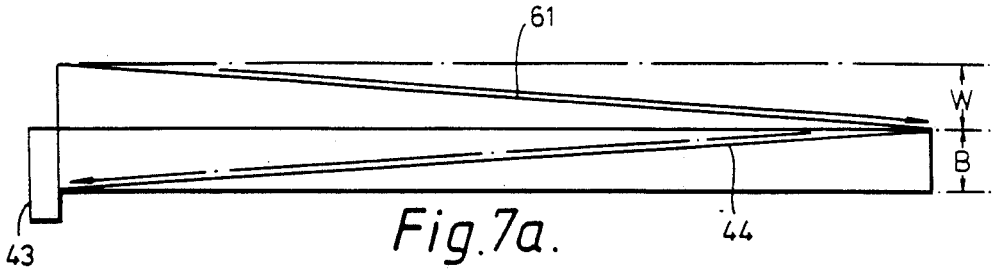
FIG. 7*a* is an elevation view showing one embodiment of a ramp configuration for use in the FIG. 3 applicator trough.
Figure 7B:
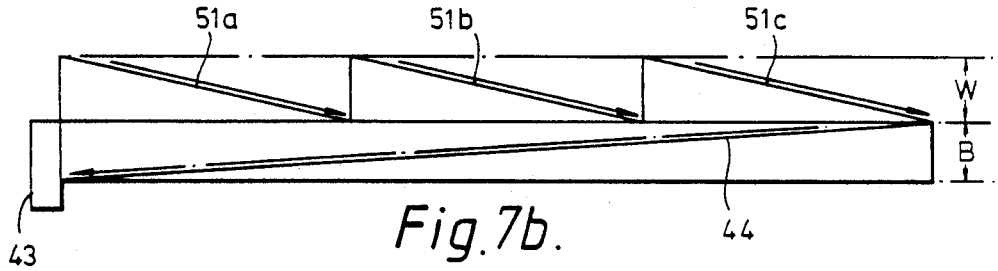
Figure 7C:
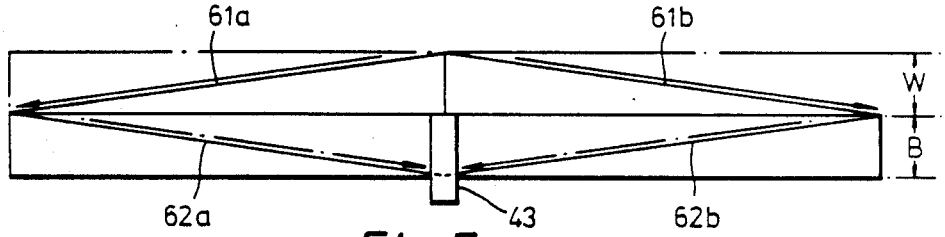
Figure 7D:
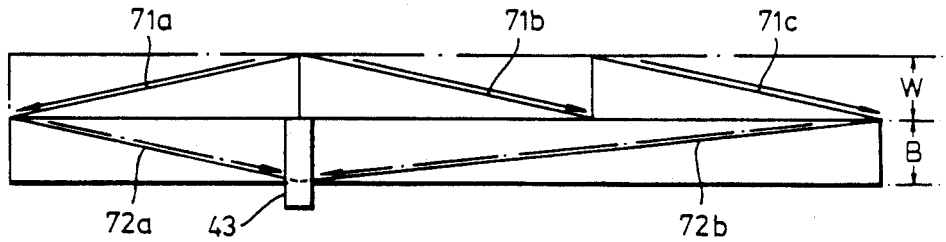

FIG. 7*b* is an elevation view showing another embodiment of a ramp configuration for use in the FIG. 3 applicator trough;

FIG. 7*c* is an elevation view showing another embodiment of a ramp configuration for use in the FIG. 3 applicator trough; and FIG. 7*d* is an elevation view showing another embodiment of a ramp configuration for use in the FIG. 3 applicator trough.

It is noted that in the various Figures the same reference numerals are used to indicate the same features.

Figure 1:
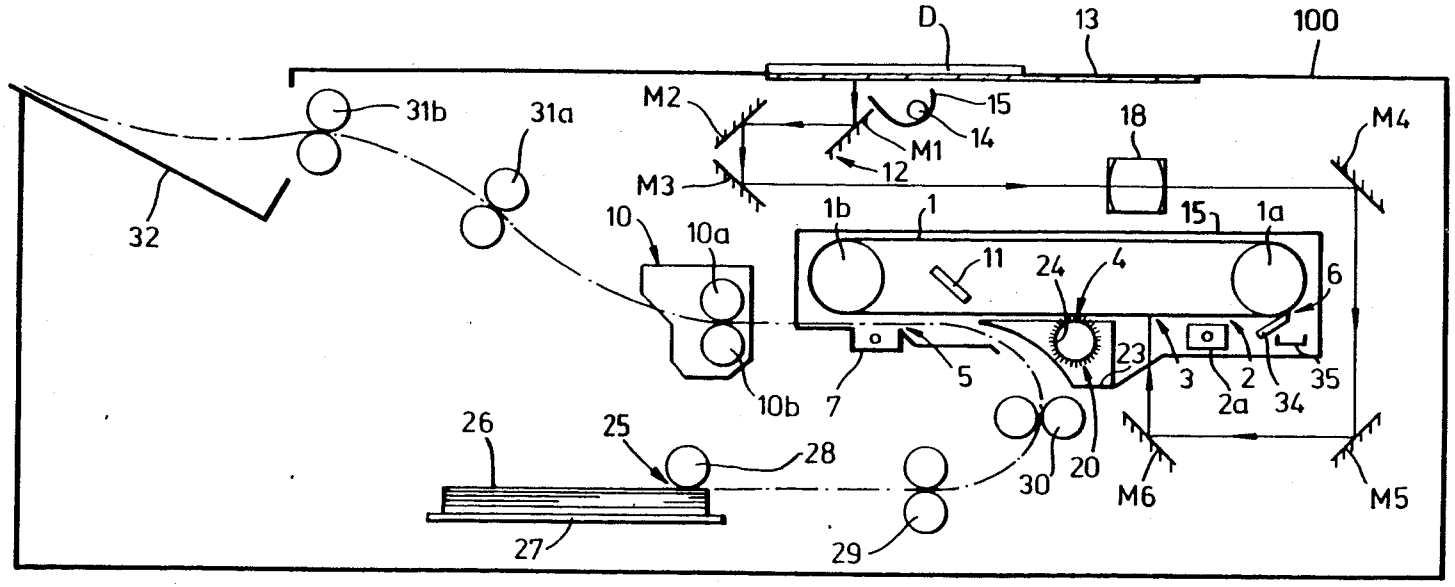
FIG. 1 is an elevation view of a xerographic copier incorporating a fusing apparatus of the present invention therein.

Referring first to FIG. 1, there is shown schematically a xerographic copying machine incorporating the present invention. The machine includes an endless flexible photoreceptor belt 1 mounted for movement (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corona generating device 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D thus exposed is imaged on to the photoreceptor 1 via a system of mirrors M1 to M6 and a focusing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 18 along its optical axis closer to the original document i.e. closer to mirrors M2 and M3, for magnification greater than unity, and away from the mirrors M2 and M3 for reduction, i.e. magnification less than unity. When the lens 18 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 4, a magnetic brush developer system 20 develops the electrostatic latent image into visible form. Here, toner is dispensed from a hopper (not shown) into developer housing 23 which contains a two-component developer mixture comprising a magnetically attractable carrier and the toner, which is deposited on the charged area of belt 1 by a developer roller 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 27. The top sheet of the stack in the tray is brought, as required, into feeding engagement with a top sheet separator/-feeder 28. Sheet feeder 28 feeds the top copy sheet of the stack towards the photoreceptor around a 180° path via two sets of nip roller pairs 29 and 30. The path followed by the copy sheets is denoted by a broken line in FIG. 1. At the transfer station 5 a transfer corona generator 7 provides an electric field to assist in the transfer of the toner particles thereto.

The copy sheet bearing the developed image is then stripped from the belt 1 and subsequently conveyed to a fusing station 10 which comprises a heated roller fuser to which release oil is applied. The image is fixed to the copy sheet by the heat and pressure in the nip between the two rollers **10*a* and 10*b* of the fuser. The final copy is fed by the fuser rollers into catch tray 32 via two further nip roller pairs 31*a* and 31*b***.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron **2*a*** as the first step in the next copy cycle.

The photoreceptor belt 1, the charge corona generator **2*a*, the developer system 20, the transfer corona generator 7, the cleaning station 6, and the erase lamp 11 may all be incorporated in a process unit 15 adapted to be removably mounted in the main assembly 100** of the xerographic copier.

Figure 2:
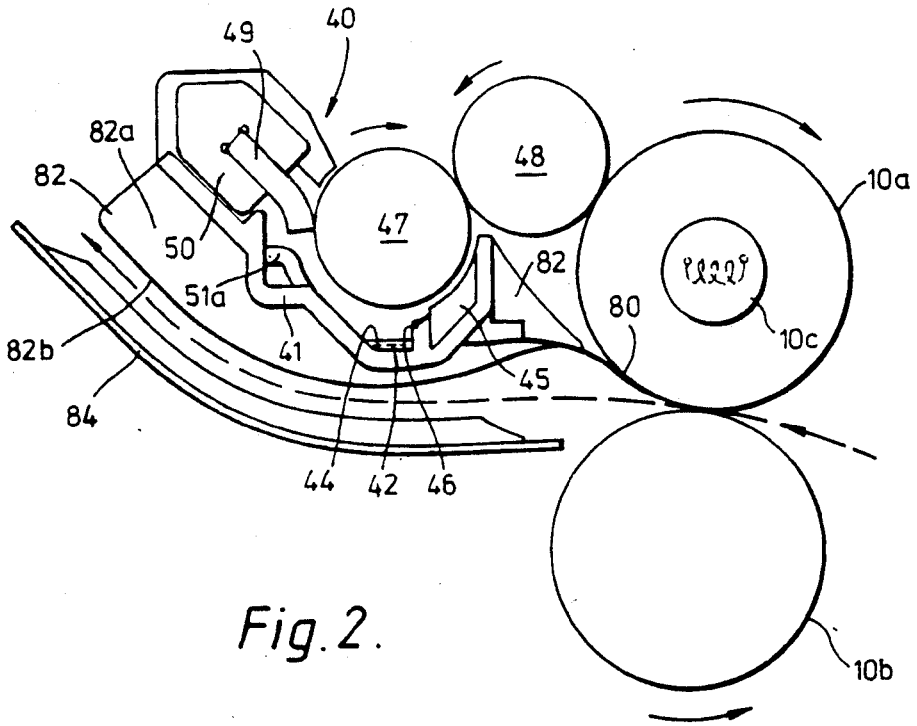
FIG. 2 is an enlarged elevation view of the fusing apparatus employing a release oil applicator used in the FIG. 1 copier.

As shown in more detail in FIG. 2, the fuser 10 comprises a driven heat roller **10*a* made for example of a steel cylinder coated in Viton (Trademark) and having a 1 KW tungsten filament lamp 10*c* disposed along its axis. A driven pressure roller 10*b* which may also comprise a steel cylinder with a Viton coating is urged against the heat roller 10*a*, for example by springs (not shown) suitably applying a force of approximately 68 kg, thereby forming a nip between the two rollers 10*a* and 10*b*** where fusing takes place.

The path of a copy sheet through the fuser is represented by a broken-line arrow in FIG. 2. In order to prevent toner offset and to aid stripping the copy sheet from the heat roller **10*a*, a silicone lubricating oil is applied to the surface roller 10*a* by an applicator 40**.

The oil applicator 40 comprises an elongated trough 41 which is also shown in different views in FIGS. 3 to 6. The release oil 42 is introduced into the trough 41 from a supply source (not shown) at an inlet 43 at one end and flows along a channel 44 at the base of the trough towards the opposite end thereof. A wick 45 is retained internally adjacent the side of the trough by a castellated wall 46 extending upwardly from the base of the trough. It is noted that, for the sake of clarity, the wick is not shown in the FIG. 5 perspective view of the trough. Release oil is able to flow through the gaps **46*a* in the wall 46 to reach the wick 45 which draws the oil up and applies it to the surface of a metering roller 47 against which the wick 45 engages. The metering roller 47, in the form of a tube made for example of stainless steel is journalled in bearings 46*a* and 46*b* at the extremities of the trough 41. The manner in which the metering arrangement operates is described in detail below. The metering roller applies the release oil to a donor roller 48 with which it is in contact and the donor roller 48 transfers a controlled amount of oil to the surface of the heat roller 10*a*. The donor roller 48 may be in the form of a tube made of for example aluminum coated with silicone rubber. The direction of rotation of all the rollers is shown by short solid-line arrows in FIG. 2, but it is noted that only the heat roller 10*a* is directly driven. The pressure roller 10*b*, the donor roller 48 and the metering roller 47 are driven by the heat roller 10*a***.

A metering blade 49 which may be made for example of an elastomer such as Viton (trade mark) is fixed in a holder 50 with the holder end of the blade set at a predetermined distance from the surface of the metering roller 47. In this manner the blade removes surplus oil from the roller 47 in a cutting tool fashion to leave thereon a coating of a predetermined thickness.

The metering blade 49 is arranged such that the surplus oil removed from the roller 47 will find its way under gravity back to channel 44 in the base of trough 41. However, in accordance with the invention, a series of three similar ramps **51*a*, 51*b*, 51*c* are disposed in saw-tooth configuration along the full length of the side wall of the trough directly below the metering blade 49. Oil which is removed from roller 47 by the blade 49 falls onto the ramps 51*a*, 51*b*, 51*c* and fills the space between the ramps and the roller 47. The direction of rotation of roller 47 tends to prevent the oil falling directly back into the channel 44 at the bottom of the trough. Instead the oil flows down the ramps under gravity before spilling over the edge back into the channel 44** at the bottom of the trough. This arrangement ensures rapid and effective distribution of the release oil along the full length of the trough as follows.

Consider the situation where release oil has been introduced into the trough at inlet 43 but has traveled only a very short distance along the channel 44 so that only a small portion of the wick 45 nearest the inlet 43 has been able to draw up any oil. In operation, the metering roller 47 will be rotated and release oil will be coated on the surface thereof by the wick, but only at the end nearest the inlet 43. However, surplus oil cutback therefrom by blade 49 will fall onto the first ramp 51*a* and will flow along the length thereof before spilling over back into the channel 44 further towards the center of the trough. This oil will then be reabsorbed by the wick and again applied to the metering roller 47, but at this stage at least one third of the roller 47 will be wetted. Again excess oil will be removed by blade 49, but this time it will also drop on to the middle ramp 51*b* which will cause the oil to be distributed along the central third of the trough. Then the oil will be drawn up by the adjacent parts of the wick 46, applied to the roller 47 and the excess oil removed by the blade 49 will then fall on to the third ramp 51*c* ensuring that the oil is distributed along the full length of the trough.

In order to set up a complete continuous circulation system the channel 44 at the base of the trough 41 may slope gently downwards from the end adjacent ramp 51*c* to the end of the trough adjacent input 43. Any excess oil may then be collected in a reservoir 52 adjacent input 43 and the level of supply oil in the trough may be set at a desired limit by providing a dam 53 at the entrance to the reservoir at a predetermined height so that only when the oil level exceeds the desired level will it spill over the dam into the reservoir.

The ramp and sloping return channel configuration described above is shown schematically in FIG. 7*b* wherein the solid line arrow arrows show the direction of distribution of oil along the trough length and the broken line arrows show the direction of the oil returning to the inlet. Vertically, the Figure is divided into two portions labeled W and B respectively, W representing the wall portion of the trough and B the base or channel portion.

The reason for choosing three ramps was to achieve an optimum gradient within the length of the trough. Clearly more ramps may be employed if a steeper gradient, and hence more rapid oil distribution is required, or fewer ramps may be employed if a less steep gradient, and hence a less rapid oil distribution will suffice. FIG. 7*a* shows schematically a single ramp 61 configuration and by comparison with FIG. 7*b* it can easily be seen how the ramp 61 is less steep than its counterpart ramps 51*a*, 51*b*, 51*c* in the FIG. 7*b* embodiment. The sloping channel 44 for returning the oil in a circulatory system is exactly the same as that in the FIG. 7*b* example.

In the embodiment described so far the oil inlet has been disposed at one end of the trough but the inlet may in fact be located anywhere along the trough. FIG. 7*c* shows an example where the inlet 43 is located approximately mid-way along the length of the trough. In this case two ramps 61*a*, 61*b* are provided each with their highest point adjacent the inlet 43 and their lowest point remote therefrom in order to promote distribution of the oil in both directions along the trough. Also the base channel of the trough may be provided with two slopes to return the oil delivered to the ends of the trough back towards the inlet 43 and hence establish continuous circulation.

It will be evident from the foregoing that the location of the oil inlet 43 and the number of ramps may be varied according to circumstances without departing from the scope of the invention. As a further example, FIG. 7*d* shows a configuration in which the inlet 43 is provided one third of the way along the length of the trough. In this case a single ramp 71*a* is provided to the left of the inlet as viewed in the Figure, sloping downwardly away therefrom; and two stepped ramps 71*b*, 71*c* on the right side of the inlet 43 both with their highest points nearest the inlet and their lowest points remote therefrom. Two return slopes 72*a*, 72*b* are provided in the channel at the base of the trough; slope 72*a* on the left-hand side of the inlet 43 to return oil delivered to the channel from the end of ramp 71*a*, and slope 72*b* on the right-hand side of inlet 43 to return oil delivered into the channel from the end of ramp 71*c*.

In addition to the release oil, mechanical aids in the form resilient of blade like stripper fingers 80 are provided at intervals along the length of the fuser system to strip the copy sheet paper from the fuser. To this end the remote end of the fingers 80 bears against the heat roller surface on the exit side of the fuser as shown in FIG. 2. As can be seen most clearly in FIGS. 3 to 6, the stripper fingers 80 which may for example be made of steel shim, are tapered and present a truncated V-shape with the tips of the fingers having a convex curvature. The stripper fingers 80 are fixed directly, to mounting platforms 83 by means of projections integral with the external wall of the trough 41, which are heat staked to form a rivet head 85. Each finger 80 has a centrally located slot 81 enabling the finger 80 to be fitted on to an external rib 82 formed integrally on the external wall of the trough. During stripping the fingers 80 tend to be deflected upwards in such manner as to increase their curvature adjacent the fuser roller 10*a*. On the upper side of the fingers 80 the ribs 82 protrude further than the slots 81 so that if the fingers are subjected to a particularly strong stripping—and hence bending—force, they abut the ribs 82 which thus provide strengthening support preventing them from flipping over in the direction of rotation of the fuser roller 10*a* while at the same time reducing the effective unsupported length so that the fingers tend to curve away from the heat roller 10*a* preventing gouging.

On the underside of the fingers 80 the ribs 82 extend around substantially the whole perimeter of the external wall surface of the trough and flare into wider portions 82*a* away from the stripper fingers 80. The ribs 82*a* have a convex outer edge 82*b*. Each rib 82 is integral with the trough so that the whole item may be molded as a unit for example from plastics material. The ribs 82 form a two-fold function, firstly they act as strengthening members for the trough, and secondly they act as an upper guide device for a copy sheet exiting the fuser rollers. The copy sheet exiting the fuser is also guided on its lower side by a guide member 84 complementary to the curved edge 82*b* of ribs 82. The guide member 84 is suitably made of sheet metal and is mounted on the fuser assembly 10. The guide ribs 82 are provided at intervals along the length of the trough, and are positioned so that one is located near the edge of all common paper sizes to inhibit jams due to edges snagging or curling. The depth of the ribs 82 is sufficient to safeguard against copy sheets contacting the underside of the trough which would generate undesirable drag forces which is beneficial because at this stage the copy sheets are hot and damp and as such their normal dry paper strength is diminished. Moreover, it will be noted that with this arrangement the stripper fingers 80 are in line with the ribs 82 so that they too function in the same beneficial manner in relation to various paper sizes and form a continuous smooth path in combination with the ribs.

In view of the foregoing description it will be evident to a person skilled in the art that various modifications of the embodiments described may be made within the scope of the present invention.

We claim:

1. An apparatus for fusing toner images on copy substrates, including:

means for applying heat and pressure to the toner images on the copy substrates;

an elongated trough containing a supply of release fluid;

means for receiving the release fluid from said elongated trough for application onto said applying means; and means for guiding the copy substrate exiting said applying means, said guiding means being formed integrally with said elongated trough, said guiding means includes a plurality of ribs projecting from the underside of said elongated trough.

2. An apparatus according to claim 1, wherein the outer edge of said plurality of ribs is convex.

3. An apparatus for fusing toner images on copy substrates, including:

means for applying heat and pressure to the toner images on the copy substrates;

an elongated trough containing a supply of release fluid;

means for receiving the release fluid from said elongated trough for application onto said applying means;

means for guiding the copy substrate exiting said applying means, said guiding means being formed integrally with said elongated trough; and means for stripping the copy substrate from said applying means, said stripping means being mounted integrally on said elongated trough.

4. An apparatus according to claim 3, wherein said stripping means includes a plurality of resilient blade like fingers.

5. An apparatus according to claim 4, wherein said plurality of fingers are arranged so that the ends thereof remote from said elongated trough engage said applying means.

6. An apparatus according to claim 4, wherein said plurality of fingers are mounted adjacent said guiding means.

7. An apparatus according to claim 4, wherein:

said guiding means include a plurality of ribs projecting from the underside of said elongated trough; and each finger of said plurality of fingers is provided with a slot to accommodate one of said plurality of ribs, said plurality of ribs being adapted to provide abutments for said plurality of fingers on the side remote from the copy substrate.

* * * * *